United States Patent [19]

Bissell et al.

[11] 4,124,109

[45] Nov. 7, 1978

[54] DISPENSING APPARATUS AND METHOD

[75] Inventors: Robin Bissell, Lederach, Pa. 19450; John T. Whitefield, Harleysville, Pa.

[73] Assignee: Robin Bissell, Lederach, Pa.

[21] Appl. No.: 767,968

[22] Filed: Feb. 11, 1977

[51] Int. Cl.[2] ..... G07F 7/08; G07F 11/00

[52] U.S. Cl. ..... 194/4 R; 194/2

[58] Field of Search ..... 194/1 D, 1 N, 4 R, 4 B, 194/4 C, 4 D, 4 E, 4 F, 4 G, 9, 10, DIG. 15, DIG. 26, 2; 221/7

[56] References Cited

U.S. PATENT DOCUMENTS

| | | | |
|---|---|---|---|
| 3,039,582 | 6/1962 | Simjian | 194/DIG. 26 |
| 3,570,643 | 3/1971 | Maierhofer | 194/4 R |
| 3,783,986 | 1/1974 | Boleu | 221/7 X |
| 3,828,903 | 8/1974 | Levasseur | 194/DIG. 15 |

*Primary Examiner*—Joseph J. Rolla

*Attorney, Agent, or Firm*—Lowe, King, Price & Becker

[57] ABSTRACT

Packets of redemption coupons are distributed from a dispensing cabinet installed in a store selling at least some of the products for coupons in the packet. A packet is dispensed in response to a depositor inserting a coin into a coin receptacle of the cabinet and a depositor inserting a coupon card into a coupon card receptacle of the cabinet. The coupon card includes a magnetic strip having magnetic indicia representing the last time the coupon card was inserted into a coupon card receptacle. While the card is in the receptacle, magnetic indicia representing the time when the card is in the receptacle are written onto the magnetic strip. In response to a mechanism in the cabinet determining whether the coin value in the receptacle is correct and whether the indicia on the card indicates that the card was last used more than a predetermined time ago, i.e., that the card indicia are correct, a dispensing mechanism of the cabinet dispenses one of the packets. In response to the card indicia being incorrect, no packet is dispensed and the coin in the coin receptacle is returned to the depositor.

19 Claims, 4 Drawing Figures

DISPENSING APPARATUS AND METHOD

FIELD OF THE INVENTION

The present invention relates generally to dispensing apparatuses and methods and more particularly to a method of an apparatus for dispensing an article in response to a coin and a card being inserted into a dispensing cabinet for the article. In accordance with another aspect of the invention, a packet of redemption coupons is dispensed in response to a correct coin amount and a card including correct indicia being inserted into a dispensing cabinet.

BACKGROUND OF THE INVENTION

A frequently employed marketing technique involves the use of redemption coupons wherein a consumer presents a coupon to a salesperson or cashier at a store and obtains a reduced price for a particular purchased item. Studies show that of the 34 billion coupons that were distributed during a recent year, only 5% were redeemed. The low redemption rate apparently occurs because of the inconvenient method of distribution, usually in periodical publications or by mail, poor timing of distribution, distribution to the perspective purchaser when he is not in close proximity to a point of purchase, or the failure of the consumer to notice and clip the coupon.

A further problem with the prior art distribution system of coupons is that it is subject to abuse by unscrupulous store owners and management personnel, as well as consumers. In many areas, great numbers of a periodical publication containing coupons are collected, coupons are clipped, and these coupons can be redeemed without the purchasing of the particular item for which the coupon was originally distributed, resulting in cash flow to owners, management personnel, and consumers, even though no product is purchased. The cost of these unscrupulous practices is absorbed in the advertising budgets of suppliers and manufacturers of products being promoted through the coupon redemption program.

A further disadvantage of the prior art method of distributing coupons is that manufacturers must pay a substantial cost for advertising space in periodicals or in mailings. The prior art coupon distribution method has a further disadvantage of usually not being correlated with retail buyers, merchandisers, store managers and supervisors so that there is frequently a high probability of a retailer having its supply of a particular product exhausted as a result of a coupon appearing in a newspaper or magazine. A further disadvantage of the prior art couponing distribution methods is that the coupon frequently has very little impact on the decision of the consumer to buy a particular product, because of the long time interval between the time the coupon is seen and cut out, and the purchase time. It is the practice of many consumers to buy a product and then determine if they have a coupon for the product, rather than buying the product because they have a coupon.

BRIEF DESCRIPTION OF THE INVENTION

In accordance with one aspect of the present invention, redemption coupons are distributed by installing a dispensing cabinet in a store and inserting packets of redemption coupons in the cabinets. Each of the packets includes at least some coupons for a product sold in the store. A consumer inserts a coin into a coin receptacle of the cabinet and also inserts a check (usually referred to as a coupon card, infra) into a card receptacle of the cabinet. The card includes indicia representing the last time the card was inserted into a check receptacle or the number of the packet that was last dispensed to the holder of the card. The cabinet includes apparatus for automatically determining whether the coin amount i.e., in the coin receptacle is correct, as well as apparatus for reading the indicia on the card in the card receptacle. The term correct coin amount and correct coin value as used in the present specification and claims includes an amount greater than the amount necessary to dispense the packet, to cover the situation of a cabinet with coin changing capabilities, as well as a correctly valued token or bill. In response to the indicia on the card indicating that the card was last used more than a predetermined time ago or that the last packet dispensed had a number different from the number being currently dispensed, i.e., that a correct card was used and the correct coin amount being in the receptacle, a dispensing mechanism of the cabinet is activated to dispense one of the packets.

From a marketing standpoint, the present invention overcomes the previous problems with coupon distribution. In particular, the use of redemption coupons is considerably increased because they are located at the point of purchase, and are obtained immediately prior to a consumer initiating the shopping process. There is no necessity to bodily remove the coupons from a periodical and they are certain to be noticed as the consumer enters the store. Further, the presence of the coupon distribution cabinets in the store spurs impulse buying of products in the coupon packet, with the resultant desirable effect of increasing sales in a particular store, as well as providing the last commercial impact on the consumer.

Because of the high redemption rate and the low participation costs, wherein manufacturers pay only the cost of printing the coupons, the present invention reduces the cost to the manufacturer over the prior art forms of coupon distribution. The retailer profits from the presence of the coupon distribution cabinets in his facility because of its profit which comes from the sale of the coupons.

Consumers eagerly participate in the use of the coupon distribution cabinets in the store because they are able to very conveniently take advantage of national brands, discount couponing and because a small, nominal cost enables the consumer immediately to save many times his initial investment. In particular, the consumer is immediately appraised of the potential savings in a particular packet because a display on an outside panel of the cabinet indicates to the consumer what product coupons are in a particular packet.

Preferably, each cabinet includes provision for dispensing and displaying two entirely different packets. The two different packets are periodically, alternately loaded into the cabinet by an employee of an organization distributing the coupons. Typically, one set of packets is loaded into the cabinet each week, so that during the course of a week, most of the packets are exhausted by purchase. After the second week has been completed, when it is expected that all coupons that were inserted into the cabinet two weeks previously are exhausted, the employee of the coupon distributor loads a complete new set of coupons into half of the distribution bins of a particular cabinet, thereby obviating the need to remove coupons from the cabinet and return them to a central center.

A particular feature of the distribution method and apparatus according to the present invention is that the problem of fraudulent misredemption is, to a large extent, obviated. In particular, each consumer is provided, generally by mail, with a single coupon card that can be utilized only once within a predetermined time interval, such as once a week, or which can be used to purchase only one particular packet. Each time the coupon card is utilized, mechanism in the cabinet writes an indication onto the card of the period of last use or of the number of the purchased packet. To energize the packet dispensing mechanism, the period of last use indication on the coupon card must be outside of the current period, or the packet number being dispensed must differ from the packet number that was last written onto the card; either of these indications is stored in a register included in the dispensing cabinet. The period or number information in the register of the cabinet is changed when an employee of the coupon distributor fills the cabinet with a new set of coupon packets.

To prevent a possible unscrupulous employee of the distributor from conspiring with store management and/or owners, the period register can be only incremented by the coupon packet inserted; incrementing can occur automatically each time the employee takes off the back of the cabinet to load packets. The period register can be decremented or reset only by management personnel of the distributor because decrementing and reset inputs to the date register can be activated only on a secure basis, with keys. Thereby, the coupon packet inserter has very little control over the date register and the store mangement cannot keep reusing coupon cards with an earlier date thereon.

Preferably, the coupon card includes a magnetic strip that is read by a mechanism included in the cabinet and which is changed while the card is in the cabinet to correspond with the time period in the period register. A card having magnetic indicia, similar to a bank credit card, is desirable because it may be utilized for an extremely long time interval without wearing out, thereby saving on card distribution costs.

Because a consumer may, in good faith, utilize his coupon card more frequently than is acceptable, the cabinet is provided with a mechanism to return a coin in the coin receptacle to a depositor in response to the period on the card indicating that the card was last used less than the predetermined time ago. For example, if a card has been utilized within the last week, and an attempt is made to utilize it again, the coin which had been put into the coin receptacle is returned to the depositor as is the coupon card.

As a further security measure, the coupon card is provided with verification indicia, preferably located on either side of the time or number indicia. In order to activate the dispensing mechanism, it is necessary for the card verification indicia to correlate with verification indicia in a register of the dispensing cabinet. By placing the verification indicia on opposite sides of the date or period indicia on the card, it is not possible to erase only the time information, by utilizing magentic techniques.

The practice of multiple redemptions by store owners and management personnel or employees of the coupon distributor for unscrupulous purposes is further obviated because each consumer is provided with one, and at the most two, coupon cards. Further security for unscrupulous coupon distributors, employees, store owners and/or managers occurs because counters are provided which index only when packets are dispensed legitimately in response to a proper card and coin within a particular period. If an abrupt change should occur within a particular period, i.e., packets missing without counter advancing or an unusual amount of advancing, an indication is provided to the organization distributing the coupons that there is a likelihood of unscrupulous practices.

While the present invention is particularly adapted to be utilized in connection with dispensing redemption coupons, it is to be understood that the invention can be utilized for dispensing other articles, such as certain pharmaceuticals, which should be dispensed only on a minimum time basis. Also, the invention can be utilized to dispense certain articles to only certain classes of purchasers, who have cards authorizing their purchase of these articles, and to restrict the purchase of these articles to unauthorized persons.

It is accordingly, an object of the present invention to provide a new and improved apparatus for and method of dispensing articles.

Another object of the invention is to provide a new and improved apparatus for and method of distributing redemption coupons.

A further object of the invention is to provide an apparatus for and method of selling articles to only certain classes of purchasers.

Another object of the invention is to provide an improved method of distributing redemption coupons wherein a greater number of coupons is utilized, wherein the cost of distributing coupons to the product manufacturer or supplier is decreased, the possibility of fraudulent misredemption is materially reduced, impulse buying on the part of the consumer is increased, and the store owner is provided with a source of profit as a result of distributing coupons.

Still another object of the invention is to provide a method of distributing packets of redemption coupons by selling them in a store only to consumers who have not purchased a packet within a relatively recent time interval, such as one week, or who have not bought a particular packet in the immediate past.

The above and still further objects, features and advantages of the present invention will become apparent upon consideration of the following detailed description of one specific embodiment thereof, especially when taken in conjunction with the accompanying drawing.

DETAILED DESCRIPTION OF THE DRAWING

Figure 1:
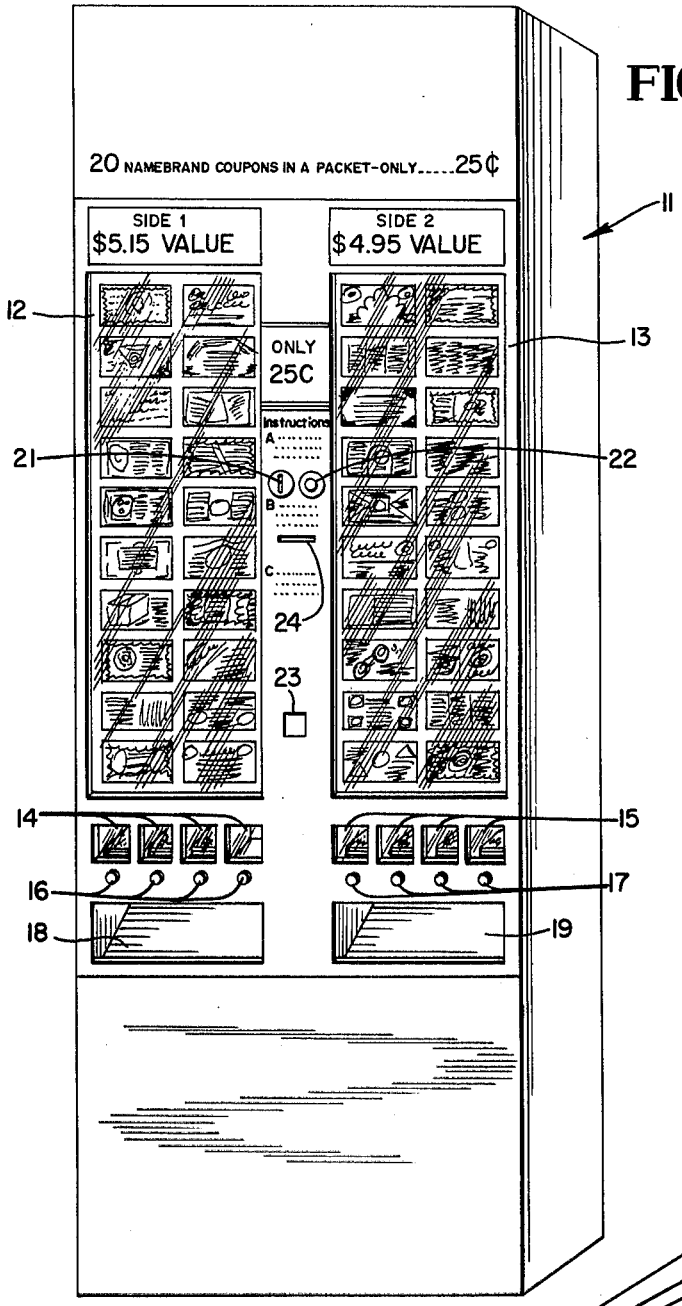
FIG. 1 is a perspective view of a coupon dispensing cabinet in accordance with a preferred embodiment of the invention.

Reference is now made to FIG. 1 of the drawing wherein there is illustrated an article dispensing cabinet 11 having display panels 12 and 13 respectively on the left and right sides of the cabinet. In each of display panels 12 and 13 are disposed separate arrays of redemption coupons similar to redemption coupons included in packets in multiple dispensing sleeves (not shown) within cabinet 11 behind the two displays. The coupons in the packets behind panel 12 differ from the coupons in the packets behind display 13. Typically, the packets behind panel 12 are loaded into the sleeves once every other week, while packets are loaded into the sleeves behind panel 13 once every alternate week so that the packets behind each panel are usually exhausted during a portion of the second week, but a supply of packets is always available. By exhausting the packets, problems associated with return are obviated. Located immediately below panels 12 and 13 are windows 14 and 15, respectively; the windows display the presence or absence of packets in the dispensing sleeves behind panels 12 and 13. Below each of windows 14 and 15 are push button actuators 16 and 17, respectively, and below the buttons are catch pockets 18 and 19 for the articles which are dispensed from the sleeves behind panels 12 and 13.

Between panels 12 and 13 are coin slot 21 and coin return button 22. Below coin slot 21 are coin return pocket 23 and horizontally oriented slot 24 which is adapted to receive a coupon card 25 (FIG. 3), preferably a plastic card similar to a credit or bank card. In the region between panels 12 and 13 and in immediately proximity to slots 21 and 24, are instruction indicia 26 advising a consumer as to the manner in which packets of redemption coupons can be obtained from cabinet 11. The indicia advise the consumer to insert a predetermined coin amount, such as 25 cents, in slot 21 and then to firmly insert coupon card 25 into slot 24 so that printed indicia, as well as a magnetic strip 27 on the coupon card, are inserted into the slot face up so that the edge of the card approximate the head of arrow 28 is pointing toward cabinet 11 as the card is inserted into the slot. The user is advised to push one of buttons 16 or 17 under one of windows 14 or 15, depending upon which window displays a packet and whether the consumer desires to purchase a packet for the coupons displayed in panel 12 or in panel 13. In response to these steps being performed and the correct indicia being read by mechanism included in the cabinet from strip 27 of card 25, a dispensing mechanism in cabinet 11 is activated and a packet is dispensed into pocket 18 or 19. If, however, the depositor has an incorrect indicia on his card, or if he has not deposited the correct amount of money, the apparatus within cabinet 11 automatically activates a coin return mechanism, the coin is returned to the depositor through pocket 23, and the card is returned to the depositor. To prevent simultaneous dispensing of plural packets and possible return of a coin while a dispensing operation is being performed, a mechanical interlock is provided between buttons 16, 17 and 22 to prevent more than one button from being pressed at any time.

Figure 2:
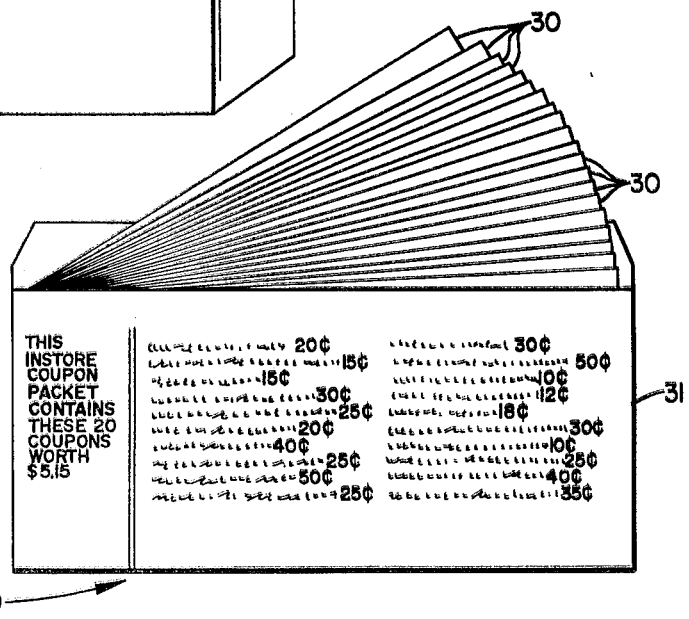
FIG. 2 is a perspective view of a coupon packet of the type to be utilized in connection with the cabinet of FIG. 1.

A typical packet is illustrated in FIG. 2 and comprises an envelope 29 in which is inserted a plurality of redemption coupons 30. On the front of the packet are located indicia 31 indicating the products for which coupons are provided and the value of each coupon, as well as indicia indicative of the number of coupons and their total worth.

Figure 3:
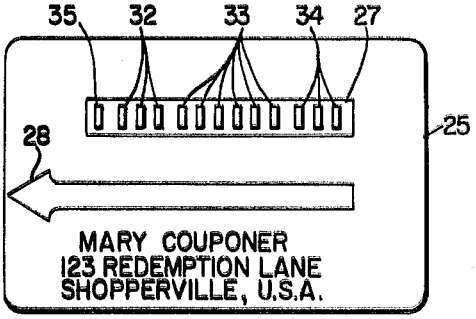
FIG. 3 is a front view of a coupon card that is particularly adapted to be utilized with the cabinet of FIG. 1.

Referring in more detail to FIG. 3, magnetic strip 27 on card 25 includes a plurality of magnetic binary bits; in one typical example, 13 bits are provided, so that there are, from left to right, a binary one bit 35 used for signalling purposes, three initial verification bits 32, followed by six time or packet number indicating bits 33, which in turn are followed by three additional verification bits 34. If card 25 is utilized for coupon redemption purposes, the card is sent, typically by mail, to all of the consumers in a particular area where cabinets 11 are installed in the stores. Similar bits on the different cards therefore initially have the same values. During proper operation, verification bits 32 and 34, as well as signal bit 35, never change in value and are merely read by mechanism included in cabinet 11. However, bits 33 are subject to being changed when card 25 is inserted into slot 34 of cabinet 11 to indicate the period when card 25 was last utilized or to indicate the number of the last packet purchased with the card, to prevent a particular consumer from using card 25 excessively within a predetermined time interval, such as 1 week, or to prevent the same packet from being purchased twice with the same card. By providing six binary bits 33, 64 different dates or numbers can be written onto strip 27. Bits 33 are placed between bits 32 and 34 so that if an attempt is made to tamper with bits 33, there will be tampering with the verification bits 32 and 34 so the card becomes effectively inoperative. If card 25 is utilized to enable certain consumers to purchase certain types of merchandise and to exclude other purchasers from purchasing that type of merchandise with card 25, indicia 32 and 34 would be different for different classes of purchasers.

Figure 4:
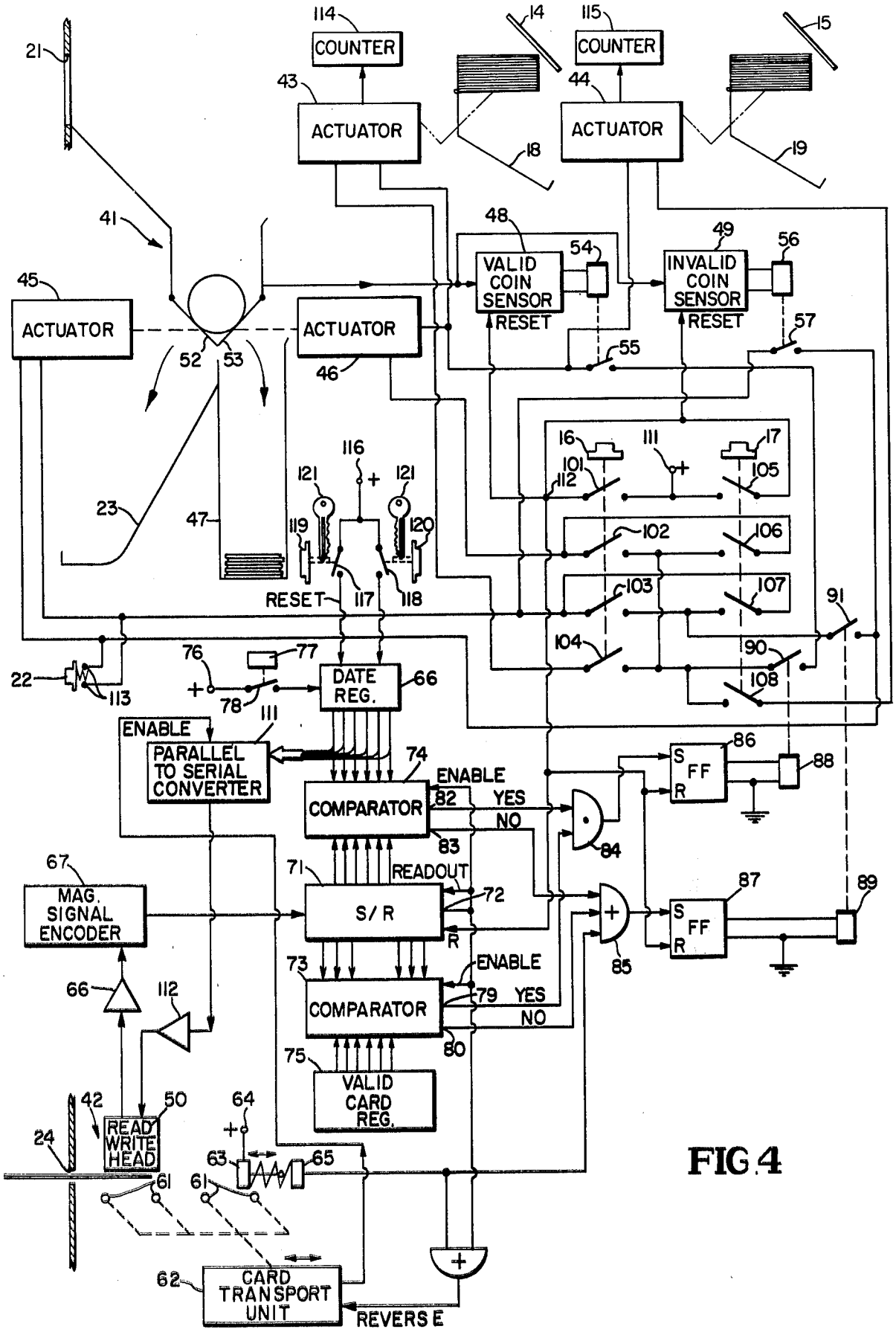
FIG. 4 is a schematic diagram of the apparatus for activating the dispensing mechanism included in the cabinet of FIG. 1.

An exemplary apparatus for activating the dispensing and coin return mechanisms of cabinet 11 is illustrated in FIG. 4. To simplify the description of FIG. 4, it is assumed that a single window 14 and button 16 and that a single window 15 and button 17 are respectively provided beneath panels 12 and 13. It is to be understood, however, that a similar mechanism is provided for each of the windows and buttons beneath panels 12 and 13.

The dispensing control apparatus of FIG. 4 includes a coin receptacle 41 responsive to coins deposited in slot 21, a card receptacle 42 responsive to cards inserted into slot 24, as well as control circuitry for energizing dispenser activating mechanisms 43 and 44, as well as actuators 45 and 46 for controlling whether a coin in receptacle 41 is returned to the depositor via pocket 23, or is fed to collection tube 47. Each of actuators 43–46 is energized only when a normally open circuit external to it, in the control circuit, is closed to complete a circuit between a pair of output leads of the actuator. The control circuitry for actuators 43–46 is responsive to valid coin sensor 48 and invalid coin sensor 49, in addition to signals read by magnetic read/write head 50 from the magnetic binary bits 32–35 on strip 27 of card 25.

Coin receptacle 41 includes gates 52 and 53, respectively responsive to actuators 45 and 46, for selectively causing the coin in the receptacle to be supplied to pocket 23 or tube 47. Gates 52 and 53 are normally closed, so that a coin in receptacle is fed to pocket 23 or tubes 47 only after one of actuators 45 or 46 is energized. While the coin is in receptacle 41, sensors 48 and 49 respond to it to determine if the correct coin amount has been deposited in the receptacle. Detecting the correct coin amount implies detecting whether the coin or coins in receptacle 41 are valid or bogus coins.

In response to the correct coin amount being deposited in receptacle 41, valid coin sensor 48 is activated, causing energization of relay 54 and closure of normally open contact 55. In contrast, if an incorrect amount of coins is deposited in receptacle 41, invalid coin sensor 49 is energized, causing relay 56 to be energized, whereby normally open contact 57 is closed. Sensors 48 and 49, once activated, remain in the activated condition until reset by a positive voltage being applied to reset input terminals thereof, whereby contacts 55 and 57 remain closed until positive voltages are applied to the reset input terminals of the sensors; actually, contacts 55 and 57 remain closed for a short time interval after the reset inputs of sensors 48 and 49 have been energized due to inherent slow release properties of relays 54 and 56.

Card receptacle 42 includes a plurality of rollers 61 for horizontally translating card 25 into the receptacle, away from slot 24 and for returning the card back to the slot. Rollers 61 are activated by a conventional card transport unit 62 which initially draws card 25 inwardly of cabinet 11, away from slot 24. Card transport unit 62 includes a reverse input terminal for reversing the direction of card 25 and causing the card to be withdrawn from cabinet 11 back through slot 24. The reverse input terminal of card transport unit 62 is energized in response to a positive voltage being applied to it, either in response to card 25 being fully translated in receptacle 42 against microswitch contact 63, or in response to all of the binary bits 32–35 on strip 27 having been read. Microswitch contact 63 is connected to a positive voltage at terminal 64 and is translated against stationary contact 65 in response to the left edge of card 25 (as viewed in FIG. 3) contacting the microswitch. The manner in which a positive voltage is applied to the reverse input terminal of card transport 62 in response to all of the bits on card 25 having been read is described infra.

As card 25 is translated into receptacle 42, magnetic bits 35, 32, 33 and 34 are read in sequence by magnetic read/write head 50. As card 25 is being withdrawn from receptacle 42, read/write head 50 writes time or number indicating bits stored in date register 66 into the six bit locations designated by reference numeral 33. The binary bits read by head 50 are coupled by amplifier 66 into magnetic signal encoder 67 which derives bilevel, binary output signals representing the zeros and ones read by head 50 from the magnetic indicia 32–35 on strip 27. The sequentially derived binary output signals of encoder 67 are supplied to digital processing circuitry in the controller to determine if validation bits 32 and 34 are correct, as well as to determine if date or number indicating bits 33 indicate that the card was used more than a predetermined time period ago, such as one week, or if the number indicated by bits 33 differs from the number in register 66. In response to the validition bits being correct and the card having been used more than the predetermined period ago, or the number indicated by bits 33 differing from the number in register 66, and a valid coin being deposited in receptacle 41, one of actuators 43 or 44 is energized, depending upon whether push button 16 or 17 is pressed, and actuator 46 is energized to open gate 53 and cause the coin in receptacle 41 to be deposited in tube 47. If however, there is no proper validation code in bits 32 and 34 or if the bits 33 are the same as in register 66, or if an improper coin amount is in receptacle 41, actuator 45 is energized to open gate 52 and return the coin to pocket 23, while neither of actuators 43 or 44 is energized.

To these ends, the control circuit includes a shift register 71 having a shift input terminal responsive to the sequentially derived bits from encoder 67. Shift register 71 includes 12 stages, one for each of the validation bits 32 and 34 and one for each of the date indicating bits 33 of strip 27 of card 25. In response to the last validation bit 34 being fed into shift register 71, the first bit fed into the shift register, binary one bit 35, is read out from the last stage of the shiit register, at terminal 72. In response to bit 35 being supplied to terminal 72, the contents of the shift register are read out in parallel, and a plus voltage is applied to the reverse input terminal of card transport unit 62, causing the transport unit to reverse the direction of card 25 so that it is withdrawn from receptacle 42 toward slot 24.

Simultaneous with readout of shift register 71, comparators 73 and 74 are enabled in response to a binary one output at terminal 72 of shift register 71. Comparators 73 and 74 are respectively responsive to predetermined binary bits derived from valid card register 75 and date or number register 66. Comparator 73 is also responsive to validation bits 32 and 34, as stored in stages 1–3 and 10–12 of shift register 71, while comparator 74 is responsive to date indicating bits 33, as stored in stages 4–9 of the shift register. For the redemption coupon application, validation card register 75 always stores the same binary bits, which are indicative of a valid card. In contrast, date or number register 66 stores a binary indication of the present time period or a number associated with the packets loaded into cabinet 11. Register 66 is incremented when an employee of the coupon distributor inserts the coupon packets of FIG. 2 into the dispensing tubes of cabinet 11; hence, register 66 is actually a binary counter that is advanced by a count of one each time the packets are put into cabinet 11. To this end, a shift input of date register 66 is selectively connected to a positive voltage at terminal 76 in response to the employee pressing button 77, in the interior of cabinet 11, to close contact 78; alternatively, contact 78 is closed each time the employee opens the back of cabinet 11 to insert packets. Each time that contact 78 is closed, the count stored in register 66 is incremented by one.

When a card has been read by head 50, comparators 73 and 74 are enabled in response to the binary one output of shift register 71, at terminal 72. If the card is valid, comparator 73 responds to the output signals of stages 1–3 and 10–12 of shift register 71 and the output of register 75 to derive a binary one output on lead 79. In contrast, if bits 32 and 34 on strip 27 do not indicate a valid card, the bits in shift register stages 1–3 and 10–12 differ from the corresponding bits in valid card register 75 so comparator 79 derives a binary one level on output lead 80 when the comparator is enabled by the signal at terminal 72.

Comparator 74, when enabled, responds to the six binary output bits of shift register stages 4–9 of register 71 and to the six output of register 66 to derive binary one levels on output leads 82 and 83 in response to the inputs to the comparator respectively differing from each other and being alike. The presence of a binary one signal on lead 82 indicates that the date or number bits 33 of card 25 differ from the date or number in register 66, whereby it is assumed that the card 25 was used more than the predetermined time ago or that the card was last used to dispense a packet different from the requested packet in cabinet 11 and that a packet is to be dispensed. In contrast, a binary one output on lead 83 indicates that bits 33 are the same as the bits in register 66 and that the card was used less than the predetermined time ago, or that the card was last used to obtain the same packet as is being requested, whereby no coupon packet is to be dispensed and the deposited coin in receptacle 41 is to be returned to the depositor.

To these ends, the binary one output signals of comparators 73 and 74, on leads 79 and 82, are combined in AND gate 84, while the binary one signals on leads 80 and 83 are combined in OR gate 85. Gates 84 and 85 respectively drive set input terminals of flip-flops 86 and 87, causing the flip-flops to be energized to the binary one state; with flip-flops 86 and 87 in the binary one state, slow release relays 88 and 89 are respectively energized, causing normally open circuited contacts 90 and 91 to be respectively closed. OR gate 85 is also selectively responsive to card 25 engaging microswitch 63 by virtue of a connection from stationary contact 65 to one input of the OR gate. Hence, contact 90 is closed in response to correct validation bits 32 and 43 being sensed from strip 27 of card 25 and correct date information being read from bits 33. Contact 91 is closed in response to card 25 being invalid because the date or number information indicated by bits 33 is improper, or improper validation bits 32–34 are included on strip 27, or there are not thirteen bits on strip 27. If thirteen bits are not on strip 27, card 25 is not reversed in direction in response to the output signal of terminal 72 of shift register 71, but is returned in response to microswitch 63 engaging stationary contact 65. From the foregoing, contacts 90 and 91 are respectively considered as valid and invalid card contacts.

Valid coin contact 55 and valid card contact 90 are connected in circuit with ganged contacts that are activated in response to buttons 16 and 17 being pressed to cause actuator 46 and one of actuators 43 or 44 to be energized. Invalid coin contact 57 and invalid card contact 91 are connected in circuit with ganged contacts responsive to push buttons 16 and 17 to energize actuator 45. Four normally open contacts 101–104 are closed in response to button 16 being pressed, while normally open contacts 105–108 are closed in response to button 17 being pressed. Contacts 102 and 106 are connected in parallel with each other, and the parallel combination is connected in series with valid coin contact 55 and valid card contact 90; in respnse to closure of either of contacts 102 or 106 and the closure of contacts 55 and 90 a circuit is completed for actuator 46, whereby the actuator is energized to cause gate 53 to open and the coin in receptacle 41 to be deposited in tube 47. Contacts 103 and 107 are connected in parallel to each other and in series with invalid card contact 91, which in turn is connected in parallel with invalid coin contact 57; contacts 57, 91, 103 and 107 are connected in circuit to output terminals of actuator 45, whereby the actuator is energized in response to either of contacts 57 or 91 being closed simultaneously with either of contacts 103 or 107 being closed. With actuator 45 energized, gate 52 is open so that the coin in receptacle 41 is returned to pocket 23. Contact 104 is connected in circuit with the output terminals of actuator 43 and in series with contacts 90 and 55, whereby a closed circuit is provided for output terminals of actuator 43 in response to button 16 being pressed while a valid coin and a valid card are sensed. With actuator 43 energized, a packet below window 14 is dispensed to pocket 18. Similarly, contact 108 is connected in series with an output terminal of actuator 44 and in series with contacts 90 and 55, so that a closed circuit is provided for the actuator in response to button 17 being closed while a valid coin and a valid card are sensed. In response to a closed circuit being established for the output terminals of actuator 44, the packet below window 15 is dispensed to pocket 19.

Contacts 101 and 105 are selectively connected to a positive DC voltage at terminal 111 so that in response to either of button 16 or 17 being pressed, a positive DC voltage is applied to terminal 112. The voltage at terminal 112 is utilized to reset sensors 48 and 49, as well as many of the electronic components, after a packet has been dispensed. To this end, reset inputs of sensors 48 and 49 are connected to terminal 112 and contacts 55 and 57 are open circuited immediately after button 16 or 17 has been pressed; there is an inherent delay in open circuiting of contacts 55 and 57 because of the delayed unlatching action of relays 54 and 56. The DC voltage at terminal 112 is also fed in parallel to reset inputs of shift register 71, as well as flip-flops 86 and 87. Thereby, the shift register and flip-flops are returned to their initial condition so that a new sequence of operations can be initiated in response to the next insertion of a card 25 into receptacle 42. Because relays 88 and 89 have delayed unlatching properties, contacts 90 and 91 are open circuited shortly after buttons 16 and 17 have been depressed, thereby enabling the circuits to actuators 43–46 to be completed.

As card 25 is being withdrawn from receptacle 42, the date or number bits stored in register 66 are sequentially applied to read/write head 50 as bits 33 are traversing the head. To this end, card transport unit 62 includes timing means for deriving a binary one output signal a predetermined time after the reversing operation has been initiated. For a valid card, the enable signal is always derived when the first time indicating binary bit 33 is passing beneath head 50. The output signal of card transport unit 62 is fed to an enable input of parallel to serial converter 111 which is responsive to the six binary bits in register 66. Converter 111 responds to the six simultaneously occurring bits in register 66 and converts them into a series of pulses that is supplied by amplifier 112 to read/write head 50. Head 50 responds to the pulses coupled to it by amplifier 12 to write magnetic bits 33 indicative of the date or number in register 66 onto strip 27. Thereby, the card cannot be utilized again until the date or number in register 66 has been advanced by closure of contact 78.

To enable a user of the cabinet to obtain a coin he has deposited into receptacle 41 prior to activation of one of contacts 16 or 17, a coin return button 22 is mechanically linked to normally open circuited switch 113. In response to switch 113 being closed, a circuit is completed for the output terminals of actuator 45, causing gate 52 to be opened so the coin in receptacle 41 is returned to pocket 23.

The apparatus of FIG. 4 is provided with several security provisions, in addition to the date or number feature. Counters 114 and 115 are provided to indicate the number of times actuators 43 and 44 are energized. Counters 114 and 115 can be reset, after having been read, when the register 66 is incremented. To prevent unscrupulous collusion between the employee and a store owner or management, register 66 can be reset or decremented only by supervisory personnel of the packet distributor organization. In particular, register 66 is provided with reset and decrement input terminals that are selectively responsive to a position DC voltage at terminal 116. The voltage at terminal 116 is applied to the reset and decrement inputs of register 66 in response to normally open circuited contacts 117 and 118 being closed by supervisory personnel respectively pushing buttons 119 and 120. Buttons 119 and 120 are provided with mechanical interlocks which can be defeated only by a key 121 being inserted therein. Typically, key 121 is carried only by the supervisory personnel so that the packet filler cannot return register 66 to a value that is the same as a number of coupon cards that he or a store owner or manager may have.

While there has been described and illustrated one specific embodiment of the invention, it will be clear that variations in the details of the embodiment specifically illustrated and described may be made without departing from the true spirit and scope of the invention as defined in the appended claims. For example, only the sensing devices could be located in the cabinet and the signals derived by them identified and fed to a central computer. If a control computer is employed, each user could have a separate identification number and a record is made of the date a particular card is used; the stored date assists in energizing the particular actuators.

What is claimed is:

1. Apparatus for activating an article dispensing mechanism in response to a coin or coins being deposited in a coin receptacle and indicia on a check deposited in a check receptacle comprising means responsive to a correct coin value being deposited in the coin receptacle for deriving a first enabling signal, means for reading the indicia on the check in the check receptacle means for deriving a second enabling signal in response to a correct value for the read indicia, and means responsive to the simultaneous occurrence of the first and second enabling signals for activating the dispensing mechanism.

2. The apparatus of claim 1 wherein the apparatus includes a mechanism for feeding a coin deposited in the receptacle to a coin return pocket, further including means for deriving a third enabling signal in response to an incorrect value for the read indicia, and means responsive to the third enabling signal for activating the feeding mechanism.

3. The apparatus of claim 2 wherein the indicia indicates time or number and further comprising a register for storing time or number indicating indicia, means for writing the stored indicia in the register on the check in the check receptacle, the written indicia replacing indicia previously on the check, wherein the means for deriving the third enabling signal is responsive to the indicia on the check in the check receptacle being the same as the indicia in the register.

4. The apparatus of claim 1 wherein the indicia indicates time or number and further comprising a register for storing time or number indicating indicia, means for writing the stored indicia in the register on the check in the check receptacle, the written indicia replacing indicia previously on the check, and the means for deriving the second enabling signal includes means for preventing derivation of the second enabling signal in response to the indicia on the check in the check receptacle being the same as the indicia in the register.

5. The apparatus of claim 4 further including means for manually changing the indication in the register.

6. The apparatus of claim 5 wherein the changing means includes means for advancing the indication in the register in unitary increments.

7. The apparatus of claim 6 wherein the changing means includes selectively activated, secure means for decrementing the indication.

8. The apparatus of claim 6 wherein the changing means includes selectively activated, secure means for resetting the indication.

9. The apparatus of claim 8 wherein the changing means includes selectively activated, secure means for decrementing the indication.

10. The apparatus of claim 1 wherein a plurality of separate dispensing mechanisms are included and further including means for manually deriving a third enabling signal for each of the mechanisms, and means for activating the selected mechanism in response to the simultaneous derivation of the third enabling signal for the selected mechanism, as well as the first and second enabling signals.

11. The apparatus of claim 10 further including means for separately counting the number of times each of the activating means is activated.

12. An article dispensing cabinet comprising a coin receptacle, a check receptacle, an article dispensing mechanism, means responsive to a correct coin value being deposited in the coin receptacle for deriving a first enabling signal, means for reading indicia on the check in the check receptacle, means for deriving a second enabling signal in response to a correct value for the read indicia, and means responsive to the simultaneous occurrence of the first and second enabling signals for activating the dispensing mechanism.

13. The cabinet of claim 12 further including a mechanism for feeding a coin deposited in the receptacle to a coin return pocket, means for deriving a thrid enabling signal in response to the read indicia having an incorrect value, and means responsive to the third enabling signal for activating the feeding mechanism.

14. A method of distributing redemption coupons comprising installing a dispensing cabinet in a store, inserting packets of said coupons in the cabinet, each of said packets including at least some coupons for products sold in the store, inserting a coin into a coin receptacle of the cabinet, inserting a check into a check receptacle of the cabinet, said check including indicia representing at least one of the last time the check was inserted into a check receptacle and a number for a packet last dispensed in response to the check being used, automatically determining whether the coin value in the coin receptacle is correct, automatically determining from the indicia on the check in the check receptacle whether a correct check is in the check receptacle, and in response to the coin value being correct and the check in the receptacle being a correct check activating a dispensing mechanism of the cabinet to dispense one of said packets.

15. The method of claim 14 further including preventing activation of the dispensing means and feeding the coin in the coin receptacle to a coin pocket of the cabinet in response to the determined check indicia indicating that the check is an incorrect check.

16. The method of claim 14 further comprising applying the indicia to the check while the check is in the check receptacle.

17. A method of dispensing an article from a dispensing cabinet including the article comprising inserting a coin into a coin receptacle of the cabinet, inserting a check into a check receptacle of the cabinet, said check including validation indicia, automatically determining whether the coin value in the coin receptacle is correct, automatically determining from the indicia on the check in the check receptacle whether a correct check is in the check receptacle, and in response to the coin value being correct and the check in the receptacle being a correct check activating a dispensing mechanism of the cabinet to dispense one of said articles.

18. The method of claim 17 further including preventing activation of the dispensing means and feeding the coin in the coin receptacle to a coin return pocket of the cabinet in response to the determined check indicia indicating that the check is an incorrect check.

19. The method of claim 17 further comprising applying the indicia to the check while the check is in the check receptacle.

* * * * *